US007568697B2

(12) United States Patent
Silverman

(10) Patent No.: US 7,568,697 B2
(45) Date of Patent: Aug. 4, 2009

(54) ENHANCED CASINO CRAPS GAME

(75) Inventor: Bruce David Silverman, Minneapolis, MN (US)

(73) Assignee: Applied Gaming Dynamics, LLC, Edina, MN (US)

( * ) Notice: Subject to any disclaimer, the term of this patent is extended or adjusted under 35 U.S.C. 154(b) by 201 days.

(21) Appl. No.: 11/156,928

(22) Filed: Jun. 20, 2005

(65) Prior Publication Data

US 2006/0186597 A1 Aug. 24, 2006

Related U.S. Application Data

(60) Provisional application No. 60/676,821, filed on May 2, 2005, provisional application No. 60/655,132, filed on Feb. 22, 2005.

(51) Int. Cl.
*A63F 9/04* (2006.01)

(52) U.S. Cl. ..... 273/146

(58) Field of Classification Search ..... None
See application file for complete search history.

(56) References Cited

U.S. PATENT DOCUMENTS 3,399,897 A * 9/1968 Mitchell ..... 273/146
3,829,098 A * 8/1974 Umminger, Jr. ..... 273/249
4,334,685 A * 6/1982 Robbins et al. ..... 273/274
4,746,126 A * 5/1988 Angileri ..... 273/249
4,902,019 A * 2/1990 Berman ..... 273/256
5,490,670 A * 2/1996 Hobert ..... 463/20
5,732,948 A * 3/1998 Yoseloff ..... 273/274
5,829,749 A * 11/1998 Hobert ..... 273/274
5,964,463 A * 10/1999 Moore, Jr. ..... 273/274
6,213,876 B1 * 4/2001 Moore, Jr. ..... 463/22
2005/0212213 A1 * 9/2005 Inglese ..... 273/292
2006/0043671 A1 3/2006 Ethier

OTHER PUBLICATIONS

"Craps—Introduction," http://www.wizardofodds.com/craps, pp. 1-10 (Apr. 24, 2006).
"Craps No More," Ameristar Casino, 2 pages (Date Unknown).
"Crapless Craps?," http://www.dicedealer.com/crapless craps.htm, 1 page (Date Printed Apr. 27, 2006).

(Continued)

*Primary Examiner*—Gene Kim
*Assistant Examiner*—Dolores Collins
(74) *Attorney, Agent, or Firm*—Merchant & Gould P.C.

(57) ABSTRACT

A method of and rules for playing variations of Craps includes novel working bets including, for example, "Place Number" bets. The invention introduces bets for any one of one or more of the numbers 2, 3, 11 and 12 occurring before the number 7 occurs in the roll of dice; bets for the individual numbers 4, 5, 6, 8, 9 and 10 occurring before any one of one or more of the numbers 2, 3, 11 and 12 occurs in the roll of the dice; bets for the individual numbers 4, 5, 6, 8, 9 and 10 occurring before either the number 7 or at least one of the numbers 2, 3, 11 and 12 occurs in the roll of dice; and a singular bet for any one of two 2s, two 3s, two 4s or two 5s occurring before any other combination of a count of 4, 6, 7, 8 or 10 and/or at least one of a count of 2, 3, 11 or 12.

10 Claims, 10 Drawing Sheets

OTHER PUBLICATIONS

"Crapless Craps: Casino Games," http://www.onlinecasinoreports.com/casinos_games/craps/crapless_craps.asp, 1 page (Apr. 21, 2006).
"Gaming Guide," Venetian Casino, 15 pages (Date Unknown).
Variations of Crap Games, http://www.wizardofodds.com/craps/crapsapx4.html, pp. 1-3 (Apr. 25, 2006).
Albert H. Morehead, Richard L. Frey, Geoffrey Mott-Smith, "*Dice Games*." The New Complete Hoyle—Revised by Richard L. Frey, et al., Jan. 1991, pp. 501-509.
Albert H. Morehead, Richard L. Frey, Geoffrey Mott-Smith, "*Craps-The Banking Game*." The New Complete Hoyle—Revised by Richard L. Frey, et al., Jan. 1991, pp. 535-540.

* cited by examiner

ENHANCED CASINO CRAPS GAME

RELATED APPLICATIONS DATA

This application claims priority from U.S. Provisional Patent Application No. 60/676,821, filed May 2, 2005, which in turn claims priority from Provisional Application No. 60/655,132, filed Feb. 22, 2005.

FIELD OF THE INVENTION

The present game relates to wagering games, casino-type games, and especially variations on games related to Craps that may be played as casino table games, electronic video games, electronic station games or internet games.

BACKGROUND OF THE INVENTION

Craps is one of the most popular casino games. It offers fast-paced, multi-dimensional action and a great variety of bets. Players can bet with the individual rolling the dice, against the individual rolling the dice or independently of the individual rolling the dice. It is this variety of wagering options and excitement generated by multiple players which make Craps so appealing.

Some of the most popular bets in Craps are the "Place Number" bets. These are individual wagers for or against the numbers 4, 5, 6, 8, 9 and 10 occurring before the number 7 occurs in the roll of the dice. Each time a Place Number bet is won, the bets placed on that number are paid off according to the odds for that bet. These bets may be temporarily taken "off" or removed altogether at any time by the player before the next roll of the dice. Place number bets that are "live" for any given roll of the dice are called "Working Bets." Working Place Number bets offer the potential for multiple payoffs in each round of Craps before a losing event occurs for the bet as well as providing only reasonable house advantages against the players.

The Place Number bets also include what are called the "Hard Way" bets. These individual bets require that a specific dice combination (pairs of 2s, 3s, 4s or 5s) for the numbers 4, 6, 8, and 10 be rolled before any other dice combination for those numbers or a seven is rolled. Specifically, that two 2s are rolled before any other combination of dice that equals 4 or any combination of 7, two 3s are rolled before any other combination of dice that totals 6 or any combination of 7, two 4s are rolled before any other combination of dice that equals 8 or any combination of 7, and two 5s are rolled before any other combination of dice that equals 10 or any combination of 7.

The Place Number and Hard Way bets have remained essentially the same over the years. And while numerous variations of Craps have been proposed that combine aspects of that game with other casino games, as well as variations of the game that include additional one-roll proposition bets or bonus bets and jackpots, these Crap game variations, on the whole, have not been successfully marketed due to the satisfaction with and appeal of the game's established rules and bets. There is an opportunity to introduce a version of the game that offers players additional wagering options that expand upon the game's most popular bets, thereby increasing the dynamics and enjoyment of the game while retaining the familiarity of the game for the player and providing the casino operator with an opportunity for incremental income.

BRIEF SUMMARY OF THE INVENTION

There are many types of individual bets that may be placed in craps. Some are one-roll proposition bets where the outcome on the very next roll of the dice determines a winning or losing event. These bets typically have longer odds and larger payouts. But they also have larger house edges, which is why many people refer to them as sucker bets.

However, other available bets, such as the Place Number bets—individual bets for the numbers 4, 5, 6, 8, 9 and 10 occurring before the number 7 occurs—can remain working for any number of rolls of the dice until the Place Number bets are withdrawn, are hit or a seven is rolled. These bets offer a great deal of appeal because players can limit their risk to specific outcomes, and if the individual rolling the dice is "hot," the bets can pay off numerous times before a losing event occurs. They also tend to have the most favorable payouts of all the craps side bets in terms of the house edge, along with the odds bet behind the Pass Line wager when the point has been established. By expanding upon the Place Number bets with various new scenarios involving different combinations of numbers, the present invention brings the following features and benefits to the game of Craps:

The invention increases the dynamics and enjoyment of the game by introducing additional Place Number bets with different parameters and/or payouts than other wagers offered in Craps.

The invention provides the casino with an opportunity for incremental income without requiring additional space, tables or game surveillance.

The invention does not alter the fundamental playing procedure or mechanics of the game.

The invention provides the casino with the flexibility to offer numerous variations of the additional Place Number bets.

The invention can be easily adopted in various gaming formats and media platforms such as single-player and multi-player video slot machines, electronic games and devices, lottery terminals, lottery scratch-off cards, home-entertainment software, online gaming applications and online non-gaming applications.

BRIEF DESCRIPTION OF THE FIGURES

The present invention will be described in detail with reference to the following drawings and betting scenarios/payout schedules. It should be noted that the invention is not limited to the configurations represented by the following drawings and that the various embodiments of the invention can be configured in any manner based on any or all of the betting scenarios enumerated in the Betting Scenarios and Payout Schedules.

Figure 3:
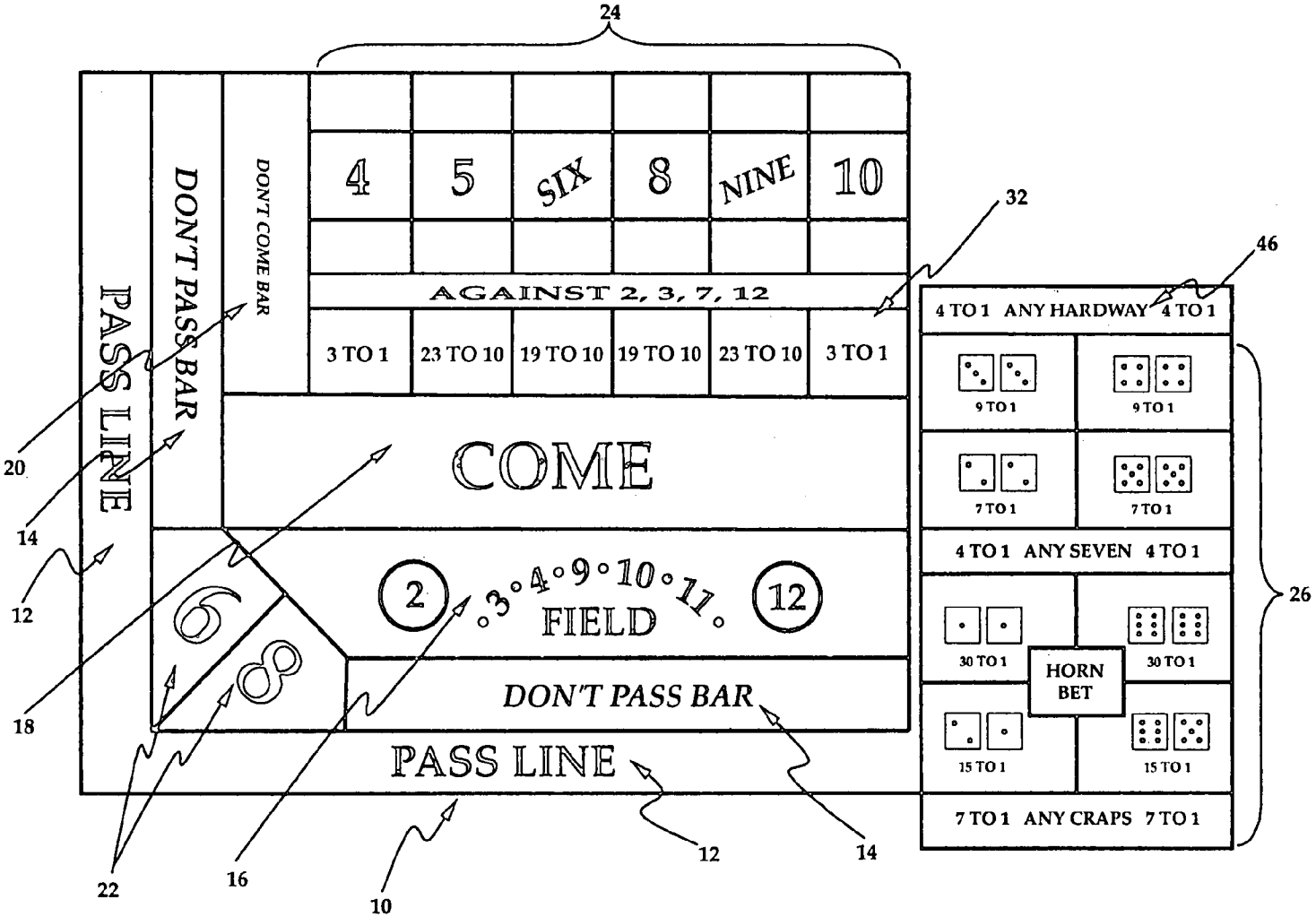

FIG. 3 is an illustration of a Craps game playing surface that provides additional wagering options (both for and against) for a 4 occurring before a 2, 3, 7 or 12; a 5 occurring before a 2, 3, 7 or 12; a 6 occurring before a 2, 3, 7 or 12; an 8 occurring before a 2, 3, 7 or 12; a 9 occurring before a 2, 3, 7 or 12; a 10 occurring before a 2, 3, 7 or 12; and a bet for any one of two 2s, two 3s, two 4s or two 5s occurring before any other combination of 4, 6, 8 or 10 or any seven.

Figure 4:
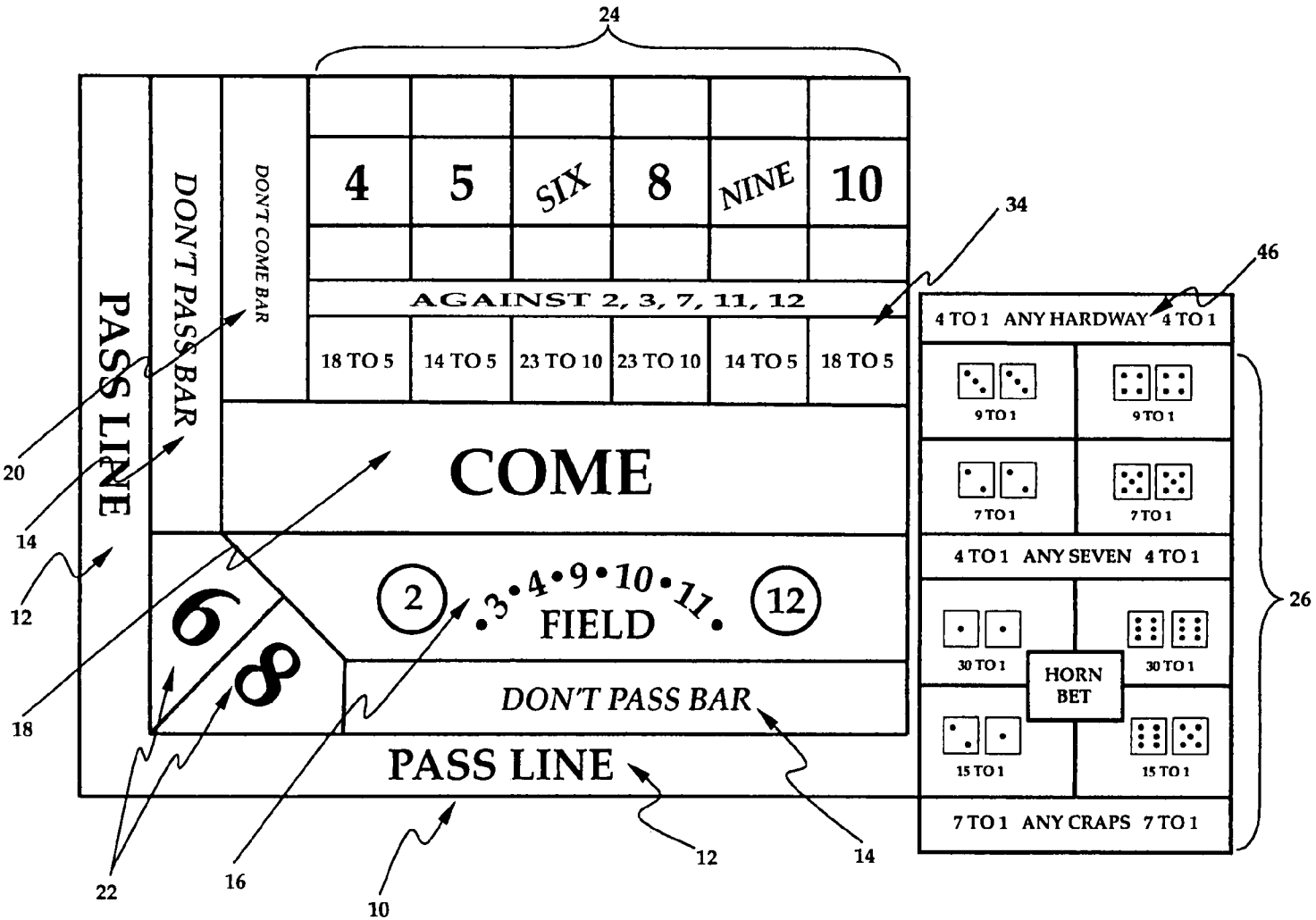

FIG. 4 is an illustration of a Craps game playing surface that provides additional wagering options (both for and against) for a 4 occurring before a 2, 3, 7, 11 or 12; a 5 occurring before a 2, 3, 7, 11 or 12; a 6 occurring before a 2, 3, 7, 11 or 12; an 8 occurring before a 2, 3, 7, 11 or 12; a 9 occurring before a 2, 3, 7, 11 or 12; a 10 occurring before a 2, 3, 7, 11 or 12; and a bet for any one of two 2s, two 3s, two 4s or two 5s occurring before any other combination of 4, 6, 8 or 10 or any seven.

Figure 5:
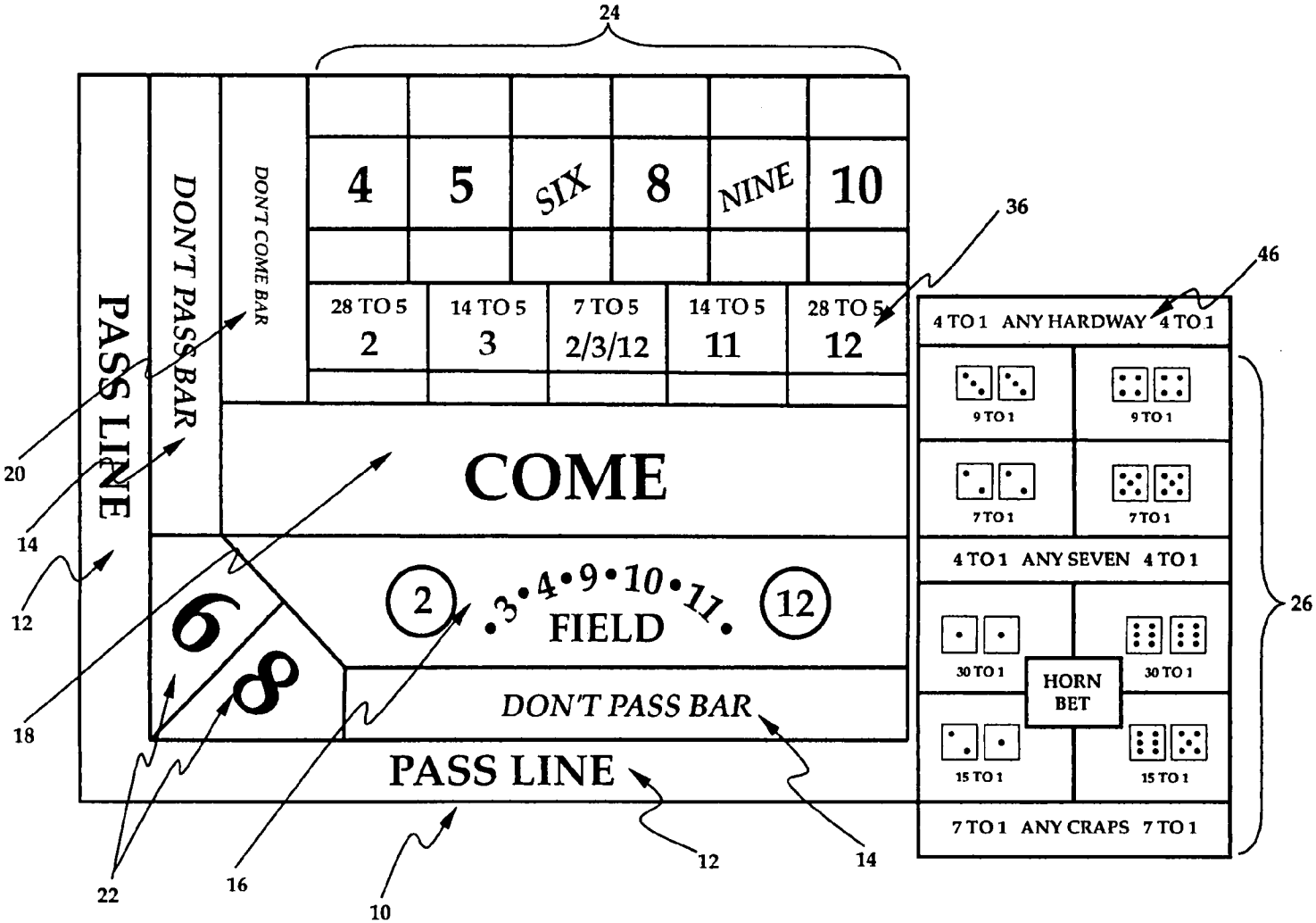

FIG. 5 is an illustration of a Craps game playing surface that provides additional wagering options (both for and against) for a 2 occurring before a 7; a 3 occurring before a 7, an 11 occurring before a 7; a 12 occurring before a 7; either a 2, 3 or 12 occurring before a 7; and a bet for any one of two 2s, two 3s, two 4s or two 5s occurring before any other combination of 4, 6, 8 or 10 or any seven.

Figure 1:
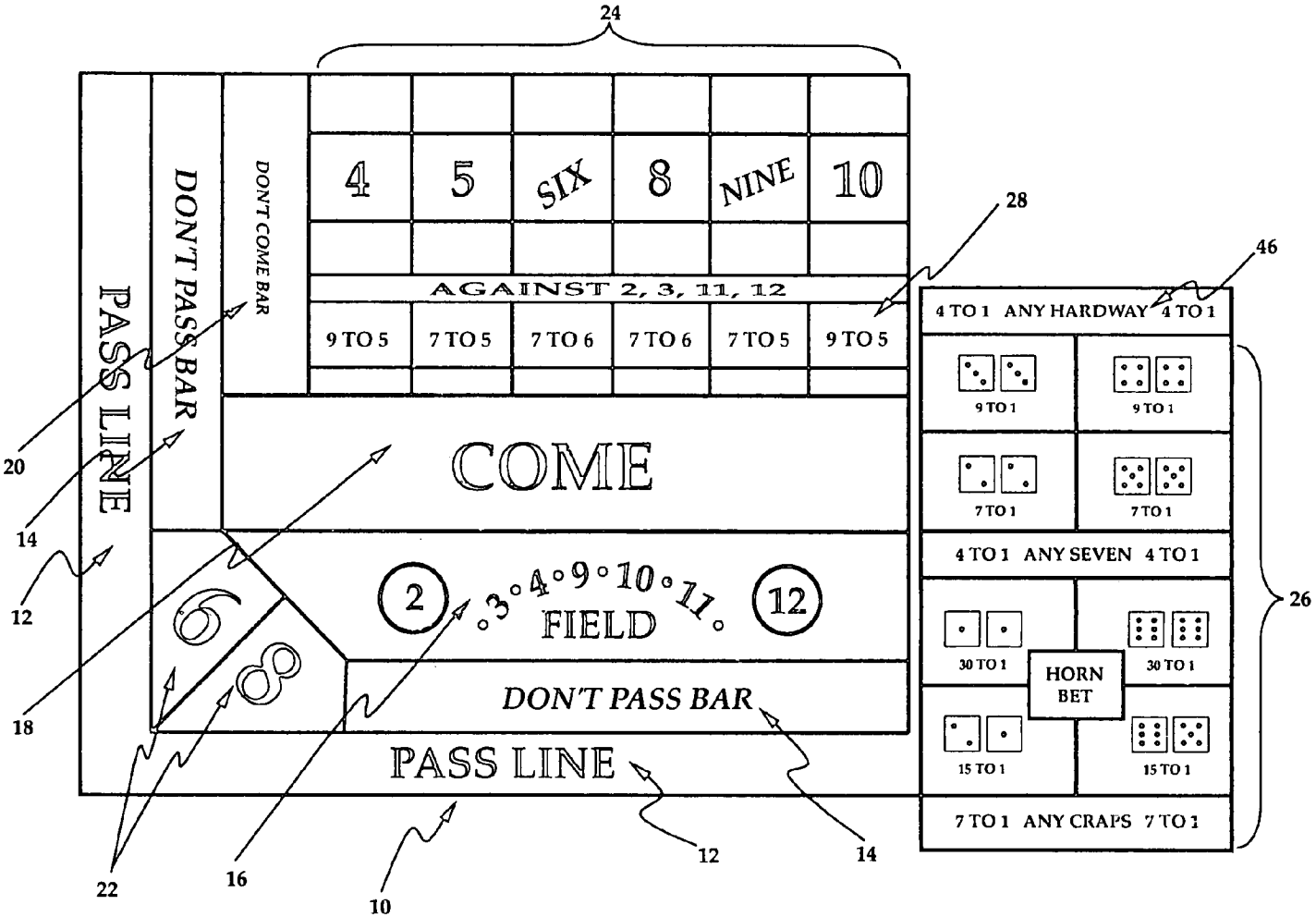
FIG. 1 is an illustration of a Craps game playing surface that provides additional wagering options (both for and against) for a 4 occurring before a 2, 3, 11 or 12; a 5 occurring before a 2, 3, 11 or 12; a 6 occurring before a 2, 3, 11 or 12; an 8 occurring before a 2, 3, 11 or 12; a 9 occurring before a 2, 3, 11 or 12; a 10 occurring before a 2, 3, 11 or 12; and a bet for any one of two 2s, two 3s, two 4s or two 5s occurring before any other combination of 4, 6, 8 or 10 or any seven.
Figure 6:
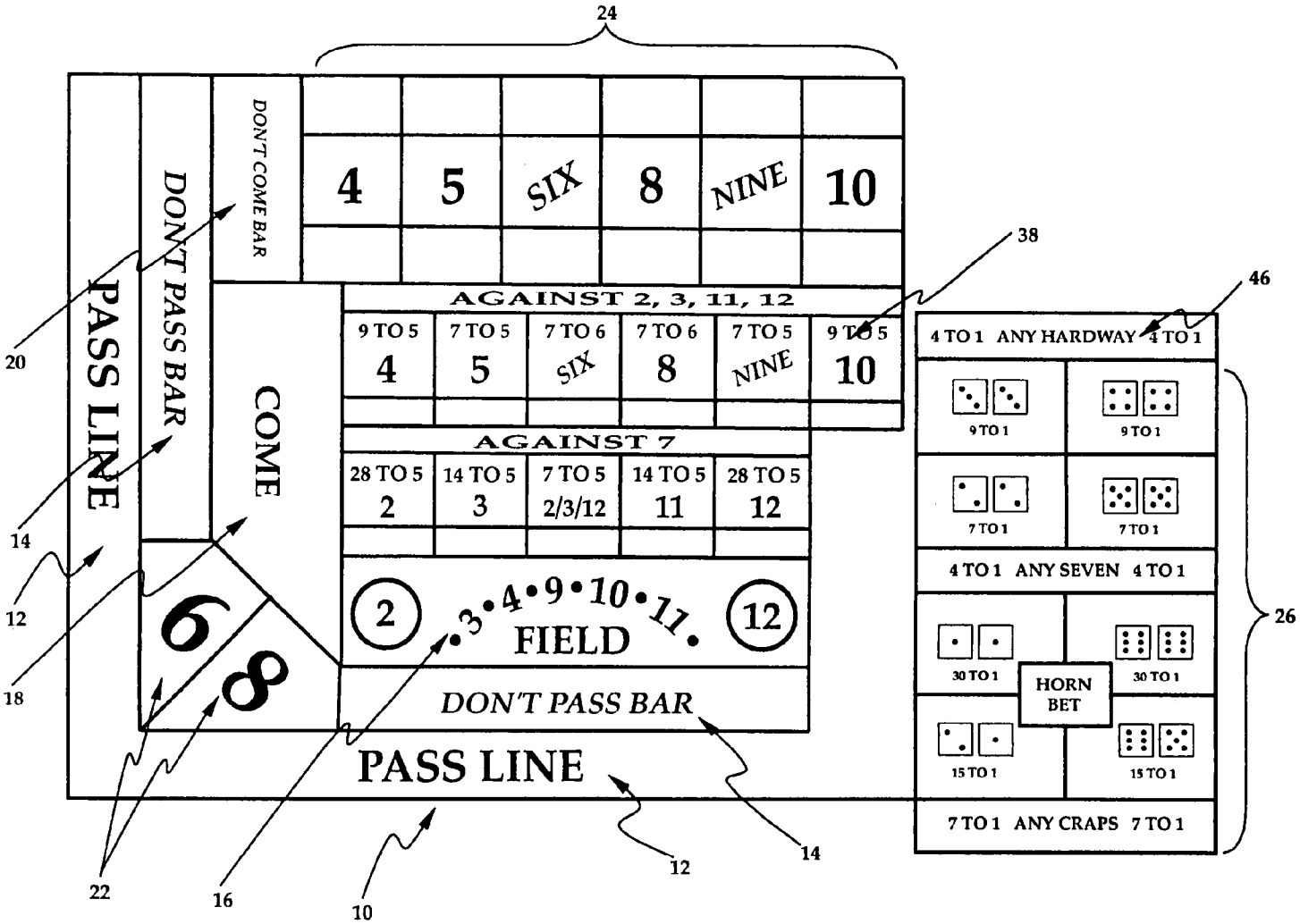

FIG. 6 is an illustration of a Craps game playing surface that combines the additional wagering options offered in FIG. 1 and FIG. 5.

Figure 2:
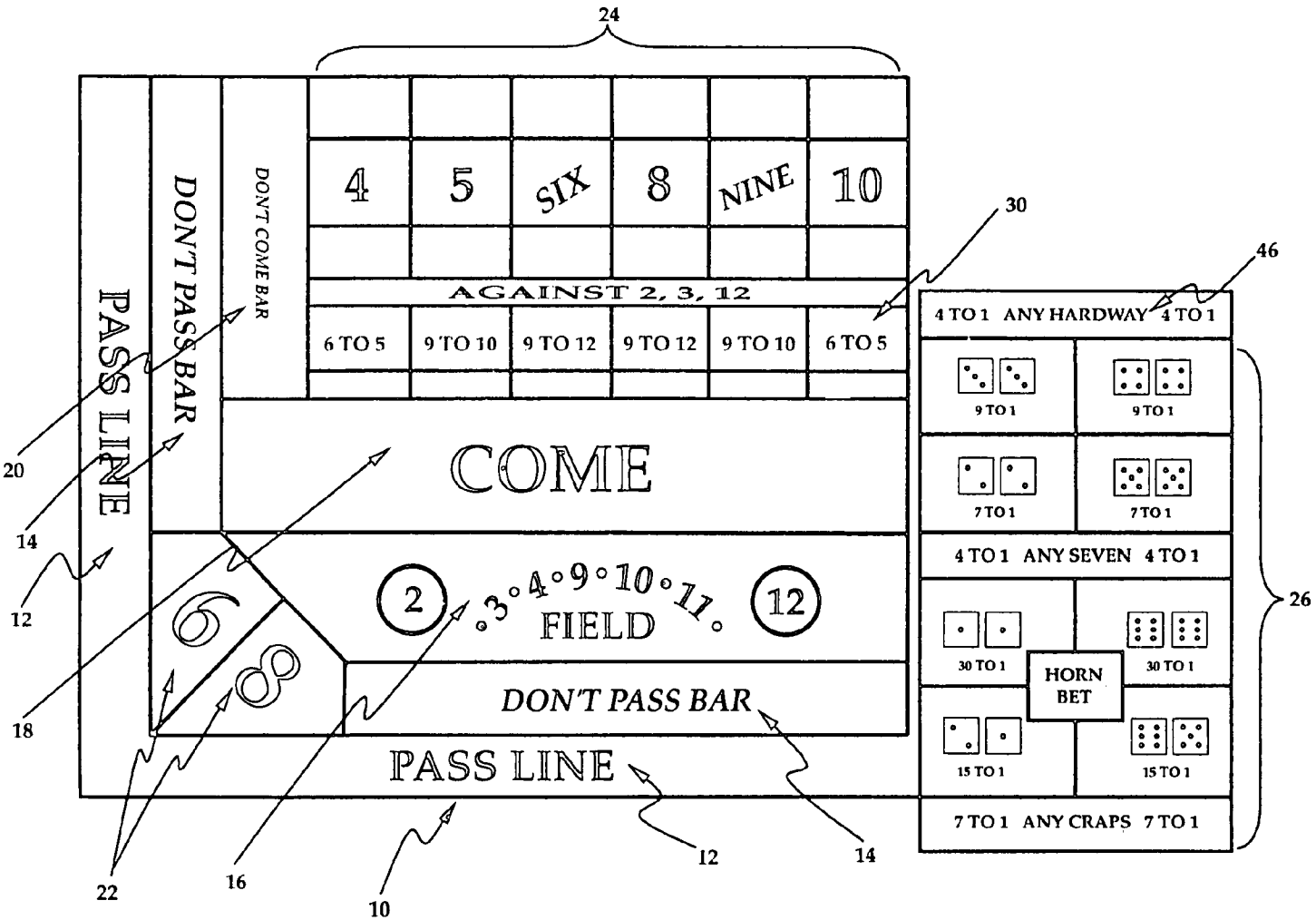
FIG. 2 is an illustration of a Craps game playing surface that provides additional wagering options (both for and against) for a 4 occurring before a 2, 3 or 12; a 5 occurring before a 2, 3 or 12; a 6 occurring before a 2, 3 or 12; an 8 occurring before a 2, 3 or 12; a 9 occurring before a 2, 3 or 12; a 10 occurring before a 2, 3 or 12; and a bet for any one of two 2s, two 3s, two 4s or two 5s occurring before any other combination of 4, 6, 8 or 10 or any seven.
Figure 7:
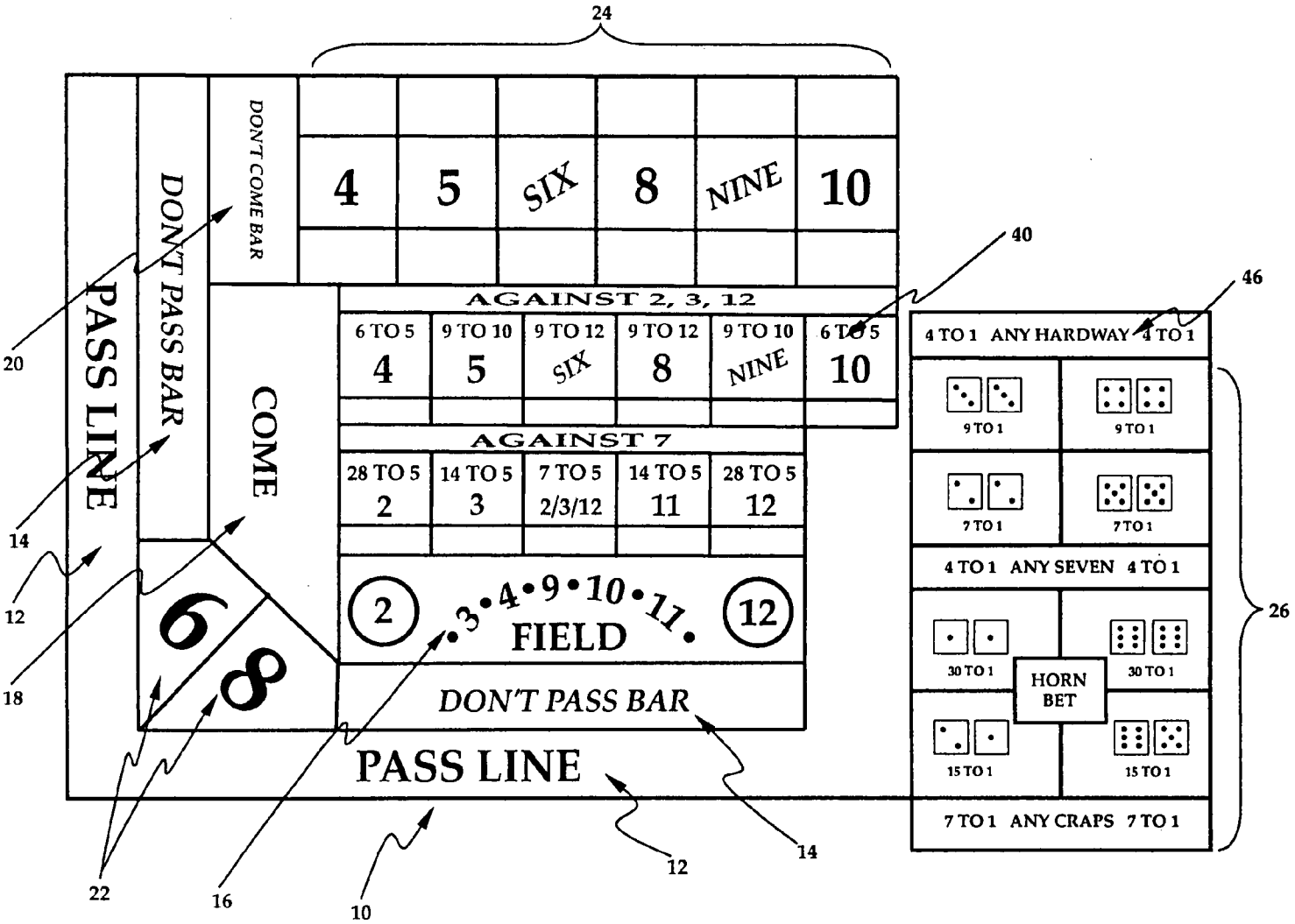

FIG. 7 is an illustration of a Craps game playing surface that combines the additional wagering options offered in FIG. 2 and FIG. 5.

Figure 8:
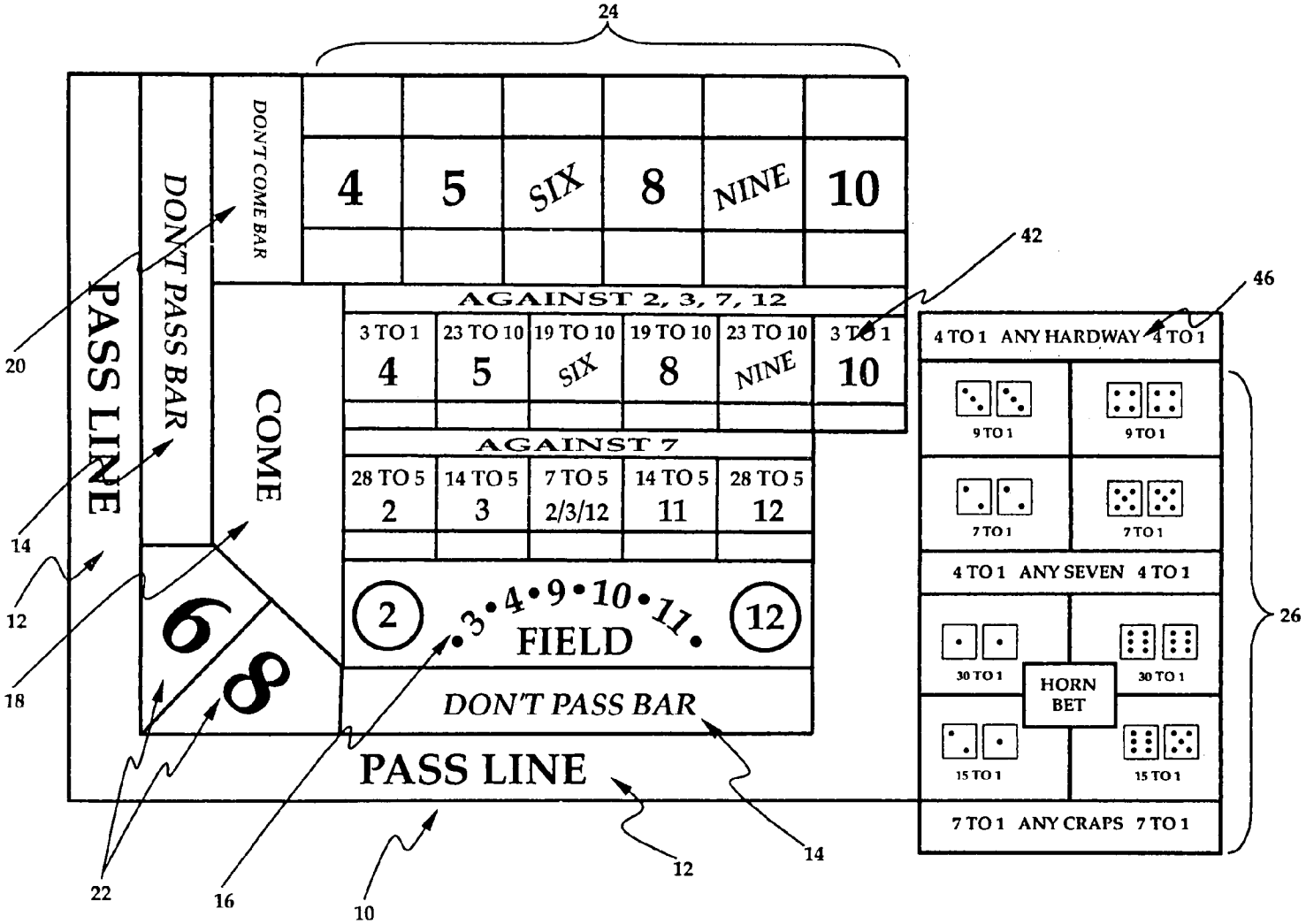

FIG. 8 is an illustration of a Craps game playing surface that combines the additional wagering options offered in FIG. 3 and FIG. 5.

Figure 9:
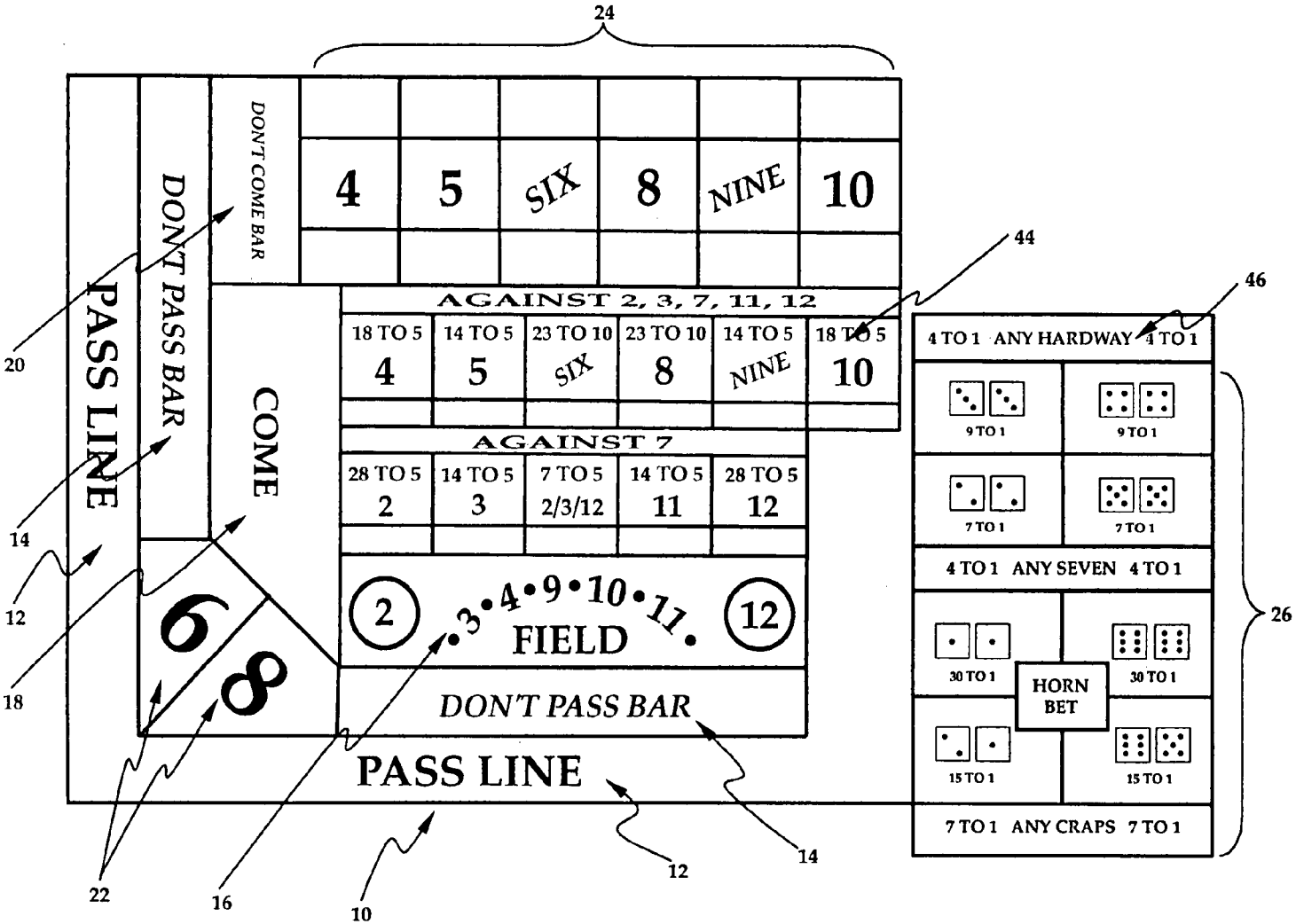

FIG. 9 is an illustration of a Craps game playing surface that combines the additional wagering options offered in FIG. 4 and FIG. 5.

Figure 10B:
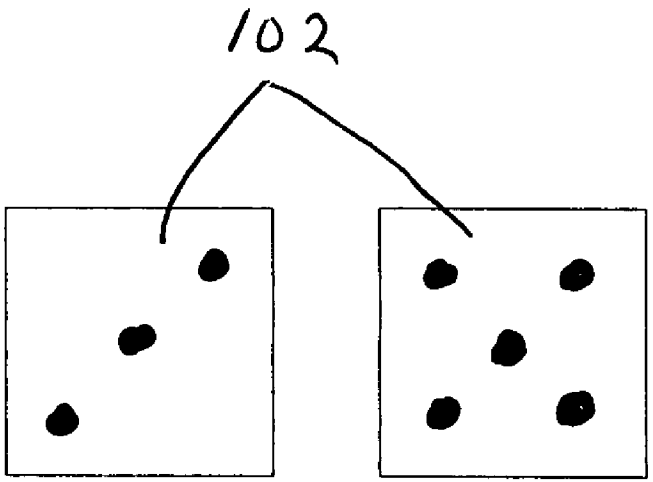
Figure 10A:
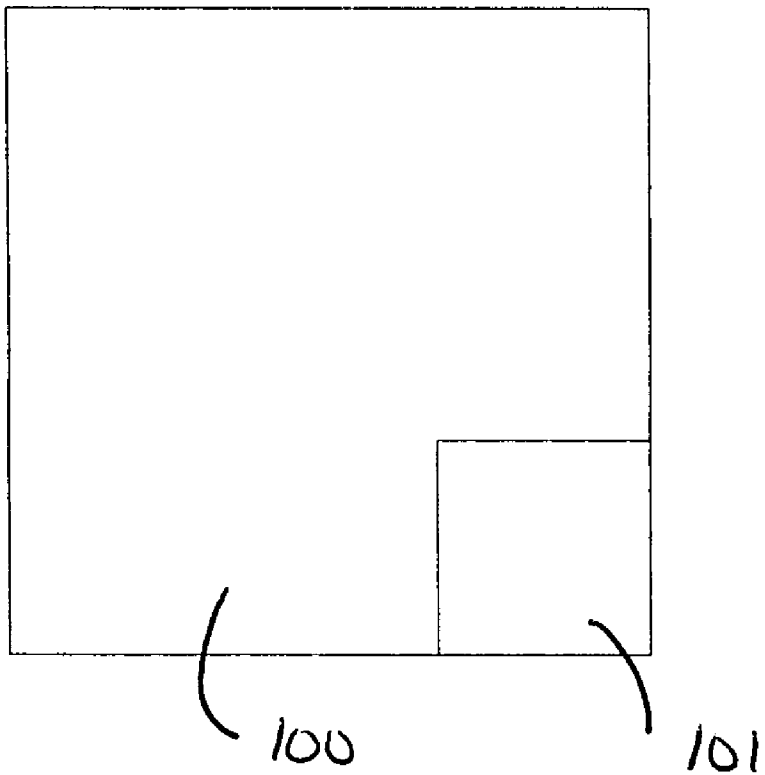

FIG. 10A illustrates an automated system that uses a random number generator to provide counts of between 2 and 12 from 36 possible combinations.

FIG. 10B illustrates physical dice.

DETAILED DESCRIPTION OF THE INVENTION

The invention applies the mathematics governing the probability of one of one or more given events occurring before one of one or more different given events within a larger set of possible events to expand on the "Place Number" bets offered in the game of Craps.

An alternative set of Place Number bets are provided that includes:

1) The occurrence of any one of one or more of the numbers 2, 3, 11 or 12 (placed as individual or collective wagers or a single collective wager with any and all combinations) before the occurrence of a 7.
2) The occurrence of a 4, 5, 6, 8, 9 or 10 (placed as individual wagers or collective wagers or a single collective wager with any and all combinations) before the occurrence of any one of one or more of the numbers 2, 3, 11 or 12.
3) The occurrence of a 4, 5, 6, 8, 9 or 10 (placed as individual wagers or collective wagers or a single collective wager with any and all combinations) before the occurrence of either the number 7 or at least one of the numbers 2, 3, 11 or 12.
4) The occurrence of any winning Hard Way bet outcome before any losing Hard Way bet outcome (placed as a collectively singular wager) and/or before the occurrence of either the number 7 (which is standard play) or at least one of the numbers 2, 3, 11 or 12.

The novel game events described herein include at least a method of playing a variation in the game of craps comprising: making a working wager on or against an event comprising the occurrence of the appearance of any one of one or more of a count of 2, 3, 11 or 12 before the appearance of a number play of 7. This is compared to conventional craps which determines wagering events on working Place Number bets only by the appearance of a 4, 5, 6, 8, 9 or 10 before the appearance of a 7. The wager may be on or against an event comprising the occurrence of a 2 before a 7; on or against an event comprising the occurrence of a 3 before a 7; on or against an event comprising the occurrence of an 11 before a 7; on or against an event comprising the occurrence of a 12 before a 7; or on or against an event comprising the occurrence of any one of two or more of a 2, 3, 11 and 12 before a 7.

The novel game events may also include a method of playing a variation of the game of craps comprising making a working wager on or against an event comprising the occurrence of the appearance of a count of 4, 5, 6, 8, 9 or 10 (placed as individual wagers) before the occurrence of any one of one or more of a count of 2, 3, 11 or 12. This is compared to conventional craps which determines wagering events on working Place Number bets by the appearance of a 4, 5, 6, 8, 9 or 10 only before the appearance of a 7. The wager may be on or against an event comprising the occurrence of a count of 4 before the appearance of one of one or more of a count of 2, 3, 11 or 12; on or against an event comprising the occurrence of the appearance of a count of 5 before the appearance of one of one or more of a count of 2, 3, 11 or 12; on or against an event comprising the occurrence of the appearance of a count of 6 before the appearance of one of one or more of a count of 2, 3, 11 or 12; on or against an event comprising the occurrence of the appearance of a count of 8 before the appearance of one of one or more of a count of 2, 3, 11 or 12; on or against an event comprising the occurrence of the appearance of a count of 9 before the appearance of one of one or more of a count of 2, 3, 11 or 12; or on or against an event comprising the occurrence of the appearance of a count of 10 before the appearance of one of one or more of a count of 2, 3, 11 or 12.

The novel game events may also include a method of playing a variation of the game of craps comprising making a working wager on or against an event comprising the occurrence of the appearance of a count of 4, 5, 6, 8, 9 or 10 (placed as individual wagers) before the occurrence of either a count of 7 or at least one of a count of 2, 3, 11 or 12. This element of the game is also compared to conventional craps which determines wagering events on working Place Number bets by the appearance of a 4, 5, 6, 8, 9 or 10 only before the appearance of a 7. The wager may be on or against an event comprising the occurrence of a count of 4 before the appearance of either a 7 or at least one of a count of 2, 3, 11, or 12; on or against an event comprising the occurrence of the appearance of a count of 5 before the appearance of either a 7 or at least one of a count of 2, 3, 11, or 12; on or against an event comprising the occurrence of the appearance of a count of 6 before the appearance of either a 7 or at least one of a count of 2, 3, 11, or 12; on or against an event comprising the occurrence of the appearance of a count of 8 before the appearance of either a 7 or at least one of a count of 2, 3, 11, or 12; on or against an event comprising the occurrence of the appearance of a count of 9 before the appearance of either a 7 or at least one of a count of 2, 3, 11, or 12; or on or against an event comprising the occurrence of the appearance of a count of 10 before the appearance of either a 7 or at least one of a count of 2, 3, 11, or 12.

The novel game events may also include a method of playing a variation of the game of craps comprising making a working wager on or against an event comprising the occurrence of the appearance of any one of either a count of two 2s, two 3s, two 4s or two 5s before the occurrence of the appearance of any other combination of a count of either 4, 6, 8 or 10 or the occurrence of the appearance of a count of 7 or a 7 and at least one of the number counts of 2, 3, 11 or 12. This is compared to conventional craps which determines wagering events on each of the Hard Way Place Number bets solely on an individual basis.

These new Place Number or working bets may be placed contemporaneously with all existing wagers, alternative wagers, and new wagers used on the Craps format. The gaming table apparatus may comprise a modified craps layout, wherein the modification comprises one or more wagering areas for placing a working wager on or against any of the events specific to the invention. The method may also be played on an automated system 100 that uses a random number generator 101 to provide number counts of between 2 and 12 from 36 possible combinations (best seen in FIG. 10A), or where physical dice 102 (best seen in FIG. 10B) are used to provide the count.

In reference to all FIGURES, the various embodiments of the invention are played on a casino-style Craps table with a playing surface 10 that accommodates a plurality of standard Craps betting options well known to those skilled in the art, including individual or group areas for a Pass Line bet 12, a Don't Pass bet 14, a Field bet 16, a Come bet 18, a Don't Come bet 20, the Big Six and Big Eight bets 22, the six traditional Place Number bets 24, and a betting area for One-Roll Proposition bets and Hard Way Place Number bets 26. When a term such as "before a 7" is used, it is meant that the event has to occur before a value of seven is rolled on the dice.

Additionally, the playing surface for each embodiment of the invention has been slightly modified from that of a traditional Craps table layout to accommodate the additional Place Number betting options specific to the invention. The following illustrated examples are indicative of the flexibility of the invention. Additional embodiments of the invention can be constructed from any of the betting scenarios outlined in the Betting Scenarios and Payout Schedules.

For the embodiment of the invention illustrated in FIG. 1, the playing surface has been modified to accommodate additional Place Number bets indicated by the shaded area 28, which provides betting options for a 4 occurring before a 2, 3, 11 or 12; a 5 occurring before a 2, 3, 11 or 12; a 6 occurring before a 2, 3, 11 or 12; an 8 occurring before a 2, 3, 11 or 12; a 9 occurring before a 2, 3, 11 or 12; and a 10 occurring before a 2, 3, 11 or 12. The playing surface in this embodiment of the invention has also been modified to accommodate an additional bet indicated by the shaded area 46 for the occurrence of any one of two 2s, two 3s, two 4s or two 5s occurring before any other combination of 4, 6, 8 or 10 or any seven. The true odds, recommended payouts and associated house edges for the embodiment of the invention illustrated in FIG. 1 are enumerated in SCHEDULES 1 and 6.

For the embodiment of the invention illustrated in FIG. 2, the playing surface has been modified to accommodate additional Place Number bets indicated by the shaded area 30, which provides betting options for a 4 occurring before a 2, 3 or 12; a 5 occurring before a 2, 3 or 12; a 6 occurring before a 2, 3 or 12; an 8 occurring before a 2, 3 or 12; a 9 occurring before a 2, 3 or 12; and a 10 occurring before a 2, 3 or 12. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 2 are enumerated in SCHEDULES 2 and 6.

For the embodiment of the invention illustrated in FIG. 3, the playing surface has been modified to accommodate additional Place Number bets indicated by the shaded area 32, which provides betting options for a 4 occurring before a 2, 3, 7 or 12; a 5 occurring before a 2, 3, 7 or 12; a 6 occurring before a 2, 3, 7 or 12; an 8 occurring before a 2, 3, 7 or 12; a 9 occurring before a 2, 3, 7 or 12; and a 10 occurring before a 2, 3, 7 or 12. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 3 are enumerated in SCHEDULES 3 and 6.

For the embodiment of the invention illustrated in FIG. 4, the playing surface has been modified to accommodate additional Place Number bets indicated by the shaded area 34, which provides betting options for a 4 occurring before a 2, 3, 7, 11 or 12; a 5 occurring before a 2, 3, 7, 11 or 12; a 6 occurring before a 2, 3, 7, 11 or 12; an 8 occurring before a 2, 3, 7, 11 or 12; a 9 occurring before a 2, 3, 7, 11 or 12; and a 10 occurring before a 2, 3, 7, 11 or 12. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 4 are enumerated in SCHEDULES 4 and 6.

For the embodiment of the invention illustrated in FIG. 5, the playing surface has been modified to accommodate additional Place Number bets indicated by the shaded area 36, which provides betting options for a 2 occurring before a 7; a 3 occurring before a 7, an 11 occurring before a 7; a 12 occurring before a 7; and a bet for either a 2, 3 or 12 occurring before a 7. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 5 are enumerated in SCHEDULES 5 and 6.

For the embodiment of the invention illustrated in FIG. 6, the playing surface has been modified to accommodate additional Place Number bets indicated by the shaded area 38, which provides betting options for a 4 occurring before a 2, 3, 11 or 12; a 5 occurring before a 2, 3, 11 or 12; a 6 occurring before a 2, 3, 11 or 12; an 8 occurring before a 2, 3, 11 or 12; a 9 occurring before a 2, 3, 11 or 12; a 10 occurring before a 2, 3, 11 or 12; a 2 occurring before a 7; a 3 occurring before a 7, an 11 occurring before a 7; a 12 occurring before a 7; and a bet for either a 2, 3 or 12 occurring before a 7. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 6 are enumerated in SCHEDULES 1, 5 and 6.

For the embodiment of the invention illustrated in FIG. 7, the playing surface has been modified to accommodate additional Place Number bets indicated by the shaded area 40, which provides betting options for a 4 occurring before a 2, 3 or 12; a 5 occurring before a 2, 3 or 12; a 6 occurring before a 2, 3 or 12; an 8 occurring before a 2, 3 or 12; a 9 occurring before a 2, 3 or 12; a 10 occurring before a 2, 3 or 12; a 2 occurring before a 7; a 3 occurring before a 7, an 11 occurring before a 7; a 12 occurring before a 7; and a bet for either a 2, 3 or 12 occurring before a 7. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 7 are enumerated in SCHEDULES 2, 5 and 6.

For the embodiment of the invention illustrated in FIG. 8, the playing surface has been modified to accommodate additional Place Number bets indicated by the shaded area 42, which provides betting options for a 4 occurring before a 2, 3, 7 or 12; a 5 occurring before a 2, 3, 7 or 12; a 6 occurring before a 2, 3, 7 or 12; an 8 occurring before a 2, 3, 7 or 12; a 9 occurring before a 2, 3, 7 or 12; a 10 occurring before a 2, 3, 7 or 12; a 2 occurring before a 7; a 3 occurring before a 7, an 11 occurring before a 7; a 12 occurring before a 7; and a bet for either a 2, 3 or 12 occurring before a 7. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 8 are enumerated in SCHEDULES 3, 5 and 6.

For the embodiment of the invention illustrated in FIG. 9, the playing surface has been modified to accommodate additional Place Number bets indicated by the shaded area 44, which provides betting options for a 4 occurring before a 2, 3, 7, 11 or 12; a 5 occurring before a 2, 3, 7, 11 or 12; a 6 occurring before a 2, 3, 7, 11 or 12; an 8 occurring before a 2, 3, 7, 11 or 12; a 9 occurring before a 2, 3, 7, 11 or 12; a 10 occurring before a 2, 3, 7, 11 or 12; a 2 occurring before a 7; a 3 occurring before a 7, an 11 occurring before a 7; a 12 occurring before a 7; and a bet for either a 2, 3 or 12 occurring before a 7. The playing surface in this embodiment of the invention has also been modified to accommodate an additional bet indicated by the shaded area 46 for any one of two 2s, two 3s, two 4s or two 5s occurring before any other combination of 4, 6, 8 or 10 or any seven. The true odds, recommended payouts and associated house edges for the embodiment of the invention illustrated in FIG. 9 are enumerated in SCHEDULES 4, 5 and 6.

For all embodiments of the invention, the game is played according to the traditional rules of Craps well known to those skilled in the art. The various embodiments of the invention allow players to make the new Place Number bets by asking the dealer to place his wager on any given Place Number bet specific to the invention just as he would ask the dealer to place his bet on any of the traditional Place Numbers. As with the traditional Place Number bets, the player does not win or lose any given bet until a winning or losing event occurs and may manage or change his bets between rolls of the dice or remove his bets altogether. Furthermore, just as with the traditional Place Number bets, the Place Number bets specific to the invention are not working on come-out rolls unless the player specifically asks for them to remain working on the come-out roll. In other words, the same rules governing the traditional Place Number bets may be applied to the Place Number bets specific to the invention.

To avoid confusion when calling out bets for the Place Numbers 4, 5, 6, 8, 9 and 10, a designated moniker can be given to the Place Number bets specific to the invention. For example, for embodiments of the invention containing a Place Number 6 bet specific to the invention, the player can call out to the dealer "place the long six" or "place the short six," meaning to place his bet on the Place Number 6 with the longer odds or the shorter odds than that of the traditional Place Number 6.

For embodiments of the invention containing the Place Numbers 2, 3, 11 and 12, the player can place a bet simply by calling out the number or group of numbers. For example, if the player wants to bet that the number 2 will occur before the number 7, the player can call out "place the two." If the player wants to bet that any one of the numbers 2, 3 or 12 will occur before a 7, he can call out "place the two-three-twelve" or "place any craps."

One way of exercising the embodiment of the invention containing a Hard Way bet, a player may place his/her bet simply by calling out "any Hard Way."

Explanation of The Underlying Mathematical Principles of the Invention

The various betting scenarios for the invention are based on the mathematical principles governing the probability of one of one or more given events occurring before one of one or more different given events within a greater finite set of events. The methodologies used to calculate the true odds payouts, recommended payouts and associated house edges for any betting scenario for the invention are as follows:

To calculate the true odds payout (T) for any betting scenario, the sum of the probabilities for the winning events occurring (W) is divided into the sum of the probabilities for the losing events occurring (L).

$$T=L/W$$

For example, to calculate the true odds payout for any one of the numbers 2, 3 or 12 occurring before the number 7, one divides the probability of either a 2, 3 or 12 occurring (2.778%+5.556%+2.778%) into the probability of a 7 occurring (16.667%) to reach a result of 1.5:1

$$T=16.667/(2.778+5.556+2.778)$$

$$T=16.667/11.112=1.5:1$$

By offering slightly less than the true odds payout, the house retains a given edge for any given betting scenario. To calculate the house edge based on a recommended payout (P) that is less than the true odds payout (T), one must consider that there are two house edge calculations to be performed—the house edge based on a single roll of the dice (S) and the total house edge (E) based on the average number of rolls of the dice needed to ensure a resolution for the betting scenario (A).

To calculate the single-roll house edge (S) for any given betting scenario, one multiplies the sum of the probabilities for the winning events occurring by the recommended payout (P) for the betting scenario and subtracts that number from the sum of the probabilities for the losing events occurring.

$$S=L-(W\times P)$$

Using the same example of any one of the numbers 2, 3 or 12 occurring before a 7, with a recommended payout of 7:5, one calculates the single-roll house edge by multiplying the sum of the probabilities for a 2, 3 and 12 occurring (11.112%) by the recommended payout (7:5) and subtracting that number from the probability of a 7 occurring (16.667%) to achieve a single-roll house edge of 1.11%.

$$S=16.667-(7/5\times 11.112)=1.11$$

To determine the total house edge (E) for any given betting scenario, one calculates how many times the dice must be rolled on average for one of the winning or losing events in the betting scenario to occur (A) and then multiplies that number by the single-roll house edge (S). The average number of rolls of the dice to ensure the occurrence of a winning or losing event for the betting scenario is defined as the sum of the probabilities for all possible events occurring divided by the sum of the probabilities for all winning and losing events occurring.

$$A=100/(W+L)$$

$$E=A\times S$$

Using the same betting scenario of a 2, 3 or 12 occurring before a 7 with the recommended payout of 7:5, one calculates the total house edge for the betting scenario as follows:

$$A=100/(11.112+16.667)=3.6$$

$$E=3.6\times 1.11=4.0$$

The above mathematical formulas can be applied to calculate the true odds, recommended payouts and associated house edges for any Place Number bet specific to the invention using the following probability figures for the eleven possible dice outcomes for the game of Craps.

| | |
|---|---|
| 2 = 2.778% | 12 = 2.778% |
| 3 = 5.556% | 11 = 5.556% |
| 4 = 8.333% | 10 = 8.333% |
| 5 = 11.111% | 9 = 11.111% |
| 6 = 13.889% | 8 = 13.889% |
| 7 = 16.667% | |

Betting Scenarios and Payout Schedules

The following betting scenarios can be used to construct various embodiments of the invention, either as configured in the drawings referenced in the Detailed Description of the Invention or as any other combination of bets that contain one or more of the following betting scenarios, none of which currently exist in the game of Craps. It should also be noted that the "Recommended Payouts" for each betting scenario are listed as a guideline and are not intended to define or limit the betting scenarios.

Schedule 1

True odds, recommended payouts and associated house edges for the individual numbers 4, 5, 6, 8, 9 and 10 occurring before any one of the numbers 2, 3, 11 or 12.

| Place To Win | True Odds Payout | Recommended Payouts | % 1-Roll House Edge | % Total House Edge |
|---|---|---|---|---|
| 4 | 2:1 | 9:5 | 1.67 | 6.67 |
| 5 | 3:2 | 7:5 | 1.11 | 4.0 |

-continued

| Place To Win | True Odds Payout | Recommended Payouts | % 1-Roll House Edge | % Total House Edge |
|---|---|---|---|---|
| 6 | 6:5 | 7:6 | .46 | 1.52 |
| 8 | 6:5 | 7:6 | .46 | 1.52 |
| 9 | 3:2 | 7:5 | 1.11 | 4.0 |
| 10 | 2:1 | 9:5 | 1.67 | 6.67 |

Note:
The bets in the above schedule can also be "bought" to receive the true odds payout in return for a commission paid on bets. This is done by paying the house a set percentage of the bought bet, such as paying $105.00 for a $100.00 bought bet. By reversing the scenarios and odds, the bets in the above schedule can also be structured as "Place To Lose" and "Lay" bets.

Schedule 2

True odds, recommended payouts and associated house edges for the individual numbers 4, 5, 6, 8, 9 and 10 occurring before any one of the numbers 2, 3 or 12.

| Place To Win | True Odds Payout | Recommended Payouts | % 1-Roll House Edge | % Total House Edge |
|---|---|---|---|---|
| 4 | 1.3:1 | 6:5 | 1.1 | 5.7 |
| 5 | 1:1 | 9:10 | 1.1 | 5.0 |
| 6 | .8:1 | 9:12 | .69 | 2.8 |
| 8 | .8:1 | 9:12 | .69 | 2.8 |
| 9 | 1:1 | 9:10 | 1.1 | 5.0 |
| 10 | 1.3:1 | 6:5 | 1.1 | 5.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 3

True odds, recommended payouts and associated house edges for the individual numbers 4, 5, 6, 8, 9 and 10 occurring before any one of the numbers 2, 3, 7 or 12.

| Place To Win | True Odds Payout | Recommended Payouts | % 1-Roll House Edge | % Total House Edge |
|---|---|---|---|---|
| 4 | 3.3:1 | 3:1 | 2.8 | 7.7 |
| 5 | 2.5:1 | 23:10 | 2.2 | 5.7 |
| 6 | 2:1 | 19:10 | 1.4 | 3.3 |
| 8 | 2:1 | 19:10 | 1.4 | 3.3 |
| 9 | 2.5:1 | 23:10 | 2.2 | 5.7 |
| 10 | 3.3:1 | 3:1 | 2.8 | 7.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 4

True odds, recommended payouts and associated house edges for the individual numbers 4, 5, 6, 8, 9 and 10 occurring before any one of the numbers 2, 3, 7, 11 or 12.

| Place To Win | True Odds Payout | Recommended Payouts | % 1-Roll House Edge | % Total House Edge |
|---|---|---|---|---|
| 4 | 4:1 | 18:5 | 3.3 | 8.0 |
| 5 | 3:1 | 14:5 | 2.2 | 5.0 |

-continued

| Place To Win | True Odds Payout | Recommended Payouts | % 1-Roll House Edge | % Total House Edge |
|---|---|---|---|---|
| 6 | 2.4:1 | 23:10 | 1.4 | 2.9 |
| 8 | 2.4:1 | 23:10 | 1.4 | 2.9 |
| 9 | 3:1 | 14:5 | 2.2 | 5.0 |
| 10 | 4:1 | 18:5 | 3.3 | 8.0 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 5

True odds, recommended payouts and associated house edges for the individual numbers 2, 3, 11 and 12 occurring before a 7 as well as any one of various combinations of the numbers 2, 3, 11 and 12 occurring before the number 7.

| Place To Win | True Odds Payout | Recommended Payouts | % 1-Roll House Edge | % Total House Edge |
|---|---|---|---|---|
| 2 | 6:1 | 28:5 | 1.1 | 5.7 |
| 3 | 3:1 | 14:5 | 1.1 | 5.0 |
| 11 | 3:1 | 14:5 | 1.1 | 5.0 |
| 12 | 6:1 | 28:5 | 1.1 | 5.7 |
| 2, 3 or 12 | 3:2 | 7:5 | 1.1 | 4.0 |
| 2, 11 or 12 | 3:2 | 7:5 | 1.1 | 4.0 |
| 2, 3 or 11 | 6:5 | 9:7 | 1.2 | 3.9 |
| 3, 11 or 12 | 6:5 | 9:7 | 1.2 | 3.9 |
| 2, 3, 11 or 12 | 1:1 | 9:10 | 1.7 | 5.0 |
| 2 or 3 | 2:1 | 9:5 | 1.7 | 6.7 |
| 11 or 12 | 2:1 | 9:5 | 1.7 | 6.7 |
| 2 or 12 | 3:1 | 14:5 | 1.1 | 5.0 |
| 3 or 11 | 3:2 | 7:5 | 1.1 | 4.0 |
| 2 or 11 | 2:1 | 9:5 | 1.7 | 6.7 |
| 3 or 12 | 2:1 | 9:5 | 1.7 | 6.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 6

True odds, recommended payout and associated house edges for any one of two 2s, two 3s, two 4s or two 5s ("Any Hard Way") occurring before any other combination of 4, 6, 8 or 10 or any 7 as well as any 7 or at least one of the numbers 2, 3 or 12.

| Place To Win | True Odds Payout | Recommended Payout | % 1-Roll House Edge | % Total House Edge |
|---|---|---|---|---|
| Any Hard Way before any easy 4, 6, 8, 10 or any 7 | 4.5:1 | 4:1 | 5.6 | 9.1 |
| Any Hard Way before any easy 4, 6, 8, 10 or any 7, 2, 3 or 12 | 5.5:1 | 5:1 | 5.6 | 7.7 |

Schedule 7

True odds, recommended payouts and associated house edges for the individual numbers 4, 5, 6, 8, 9 and 10 occurring before any one of the numbers 2, 3, 7 or 11.

| Place To Win | True Odds Payout | Recommended Payouts | % 1-Roll House Edge | % Total House Edge |
|---|---|---|---|---|
| 4 | 3.67:1 | 17:5 | 2.2 | 5.7 |
| 5 | 2.75:1 | 13:5 | 1.67 | 4.0 |
| 6 | 2.2:1 | 15:7 | .8 | 1.8 |
| 8 | 2.2:1 | 15:7 | .8 | 1.8 |
| 9 | 2.75:1 | 13:5 | 1.67 | 4.0 |
| 10 | 3.67:1 | 17:5 | 2.2 | 5.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 8

True odds, recommended payouts and associated house edges for the individual numbers 4, 5, 6, 8, 9 and 10 occurring before any one of the numbers 2, 11 or 12.

| Place To Win | True Odds Payout | Recommended Payouts | % 1-Roll House Edge | % Total House Edge |
|---|---|---|---|---|
| 4 | 1.3:1 | 6:5 | 1.1 | 5.7 |
| 5 | 1:1 | 9:10 | 1.1 | 5.0 |
| 6 | .8:1 | 9:12 | .69 | 2.8 |
| 8 | .8:1 | 9:12 | .69 | 2.8 |
| 9 | 1.1:1 | 9:10 | 1.1 | 5.0 |
| 10 | 1.3:1 | 6:5 | 1.1 | 5.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 9

True odds, recommended payouts and associated house edges for the individual numbers 4, 5, 6, 8, 9 and 10 occurring before any one of the numbers 2, 3 or 11.

| Place To Win | True Odds Payout | Recommended Payouts | % 1-Roll House Edge | % Total House Edge |
|---|---|---|---|---|
| 4 | 1.67:1 | 9:6 | 1.4 | 6.2 |
| 5 | 1.25:1 | 7:6 | .93 | 3.7 |
| 6 | 1:1 | 14:15 | .93 | 3.3 |
| 8 | 1:1 | 14:15 | .93 | 3.3 |
| 9 | 1.25:1 | 7:6 | .93 | 3.7 |
| 10 | 1.67:1 | 9:6 | 1.4 | 6.2 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 10

True odds, recommended payouts and associated house edges for the individual numbers 4, 5, 6, 8, 9 and 10 occurring before any one of the numbers 3, 11 or 12.

| Place To Win | True Odds Payout | Recommended Payouts | % 1-Roll House Edge | % Total House Edge |
|---|---|---|---|---|
| 4 | 1.67:1 | 9:6 | 1.4 | 6.2 |
| 5 | 1.25:1 | 7:6 | .93 | 3.7 |

-continued

| Place To Win | True Odds Payout | Recommended Payouts | % 1-Roll House Edge | % Total House Edge |
|---|---|---|---|---|
| 6 | 1:1 | 14:15 | .93 | 3.3 |
| 8 | 1:1 | 14:15 | .93 | 3.3 |
| 9 | 1.25:1 | 7:6 | .93 | 3.7 |
| 10 | 1.67:1 | 9:6 | 1.4 | 6.2 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 11

True odds, recommended payouts and associated house edges for the individual numbers 4, 5, 6, 8, 9 and 10 occurring before any one of the numbers 2, 7 or 11.

| Place To Win | True Odds Payout | Recommended Payouts | % 1-Roll House Edge | % Total House Edge |
|---|---|---|---|---|
| 4 | 3:1 | 14:5 | 1.7 | 5.0 |
| 5 | 2.25:1 | 12:5 | 1.7 | 4.6 |
| 6 | 1.8:1 | 12:7 | 1.2 | 3.1 |
| 8 | 1.8:1 | 12:7 | 1.2 | 3.1 |
| 9 | 2.25:1 | 12:5 | 1.7 | 4.6 |
| 10 | 3:1 | 14:5 | 1.7 | 5.0 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 12

True odds, recommended payouts and associated house edges for the individual numbers 4, 5, 6, 8, 9 and 10 occurring before any one of the numbers 2, 7 or 12.

| Place To Win | True Odds Payout | Recommended Payouts | % 1-Roll House Edge | % Total House Edge |
|---|---|---|---|---|
| 4 | 2.7:1 | 12:5 | 2.2 | 7.3 |
| 5 | 2:1 | 9:5 | 2.2 | 6.7 |
| 6 | 1.6:1 | 9:6 | 1.4 | 3.8 |
| 8 | 1.6:1 | 9:6 | 1.4 | 3.8 |
| 9 | 2:1 | 9:5 | 2.2 | 6.7 |
| 10 | 2.7:1 | 12:5 | 2.2 | 7.3 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 13

True odds, recommended payouts and associated house edges for the individual numbers 4, 5, 6, 8, 9 and 10 occurring before any one of the numbers 2, 7, 11 or 12.

| Place To Win | True Odds Payout | Recommended Payouts | % 1-Roll House Edge | % Total House Edge |
|---|---|---|---|---|
| 4 | 3.3:1 | 3:1 | 2.8 | 7.7 |
| 5 | 2.5:1 | 23:10 | 2.2 | 5.7 |
| 6 | 2:1 | 19:10 | 1.4 | 3.3 |

-continued

| Place To Win | True Odds Payout | Recommended Payouts | % 1-Roll House Edge | % Total House Edge |
|---|---|---|---|---|
| 8 | 2:1 | 19:10 | 1.4 | 3.3 |
| 9 | 2.5:1 | 23:10 | 2.2 | 5.7 |
| 10 | 3.3:1 | 3:1 | 2.8 | 7.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 14

True odds, recommended payouts and associated house edges for the individual numbers 4, 5, 6, 8, 9 and 10 occurring before any one of the numbers 3, 7 or 11.

| Place To Win | True Odds Payout | Recommended Payouts | % 1-Roll House Edge | % Total House Edge |
|---|---|---|---|---|
| 4 | 3.3:1 | 3:1 | 2.8 | 7.7 |
| 5 | 2.5:1 | 23:10 | 2.2 | 5.7 |
| 6 | 2:1 | 19:10 | 1.4 | 3.3 |
| 8 | 2:1 | 19:10 | 1.4 | 3.3 |
| 9 | 2.5:1 | 23:10 | 2.2 | 5.7 |
| 10 | 3.3:1 | 3:1 | 2.8 | 7.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 15

True odds, recommended payouts and associated house edges for the individual numbers 4, 5, 6, 8, 9 and 10 occurring before any one of the numbers 3, 7 or 12.

| Place To Win | True Odds Payout | Recommended Payouts | % 1-Roll House Edge | % Total House Edge |
|---|---|---|---|---|
| 4 | 3:1 | 14:5 | 1.7 | 5.0 |
| 5 | 2.25:1 | 12:5 | 1.7 | 4.6 |
| 6 | 1.8:1 | 12:7 | 1.2 | 3.1 |
| 8 | 1.8:1 | 12:7 | 1.2 | 3.1 |
| 9 | 2.25:1 | 12:5 | 1.7 | 4.6 |
| 10 | 3:1 | 14:5 | 1.7 | 5.0 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 16

True odds, recommended payouts and associated house edges for the individual numbers 4, 5, 6, 8, 9 and 10 occurring before any one of the numbers 3, 7, 11 or 12.

| Place To Win | True Odds Payout | Recommended Payouts | % 1-Roll House Edge | % Total House Edge |
|---|---|---|---|---|
| 4 | 3.67:1 | 17:5 | 2.2 | 5.7 |
| 5 | 2.75:1 | 13:5 | 1.67 | 4.0 |
| 6 | 2.2:1 | 15:7 | .8 | 1.8 |
| 8 | 2.2:1 | 15:7 | .8 | 1.8 |

-continued

| Place To Win | True Odds Payout | Recommended Payouts | % 1-Roll House Edge | % Total House Edge |
|---|---|---|---|---|
| 9 | 2.75:1 | 13:5 | 1.67 | 4.0 |
| 10 | 3.67:1 | 17:5 | 2.2 | 5.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 17

True odds, recommended payouts and associated house edges for the individual numbers 4, 5, 6, 8, 9 and 10 occurring before any one of the numbers 2, 3 or 7.

| Place To Win | True Odds Payout | Recommended Payouts | % 1-Roll House Edge | % Total House Edge |
|---|---|---|---|---|
| 4 | 3:1 | 14:5 | 1.7 | 5.0 |
| 5 | 2.25:1 | 12:5 | 1.7 | 4.6 |
| 6 | 1.8:1 | 12:7 | 1.2 | 3.1 |
| 8 | 1.8:1 | 12:7 | 1.2 | 3.1 |
| 9 | 2.25:1 | 12:5 | 1.7 | 4.6 |
| 10 | 3:1 | 14:5 | 1.7 | 5.0 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 18

True odds, recommended payouts and associated house edges for the individual numbers 4, 5, 6, 8, 9 and 10 occurring before any one of the numbers 7, 11 or 12.

| Place To Win | True Odds Payout | Recommended Payouts | % 1-Roll House Edge | % Total House Edge |
|---|---|---|---|---|
| 4 | 3:1 | 14:5 | 1.7 | 5.0 |
| 5 | 2.25:1 | 12:5 | 1.7 | 4.6 |
| 6 | 1.8:1 | 12:7 | 1.2 | 3.1 |
| 8 | 1.8:1 | 12:7 | 1.2 | 3.1 |
| 9 | 2.25:1 | 12:5 | 1.7 | 4.6 |
| 10 | 3:1 | 14:5 | 1.7 | 5.0 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 19

True odds, recommended payouts and associated house edges for the individual numbers 4, 5, 6, 8, 9 and 10 occurring before either of the numbers 2 or 7.

| Place To Win | True Odds Payout | Recommended Payouts | % 1-Roll House Edge | % Total House Edge |
|---|---|---|---|---|
| 4 | 2.3:1 | 2:1 | 2.8 | 10.0 |
| 5 | 1.75:1 | 8:5 | 1.7 | 5.5 |
| 6 | 1.4:1 | 8:6 | .93 | 2.8 |
| 8 | 1.4:1 | 8:6 | .93 | 2.8 |

-continued

| Place To Win | True Odds Payout | Recommended Payouts | % 1-Roll House Edge | % Total House Edge |
|---|---|---|---|---|
| 9 | 1.75:1 | 8:5 | 1.7 | 5.5 |
| 10 | 2.3:1 | 2:1 | 2.8 | 10.0 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 20

True odds, recommended payouts and associated house edges for the individual numbers 4, 5, 6, 8, 9 and 10 occurring before either of the numbers 3 or 7.

| Place To Win | True Odds Payout | Recommended Payouts | % 1-Roll House Edge | % Total House Edge |
|---|---|---|---|---|
| 4 | 2.7:1 | 12:5 | 2.2 | 7.3 |
| 5 | 2:1 | 9:5 | 2.2 | 6.7 |
| 6 | 1.6:1 | 9:6 | 1.4 | 3.8 |
| 8 | 1.6:1 | 9:6 | 1.4 | 3.8 |
| 9 | 2:1 | 9:5 | 2.2 | 6.7 |
| 10 | 2.7:1 | 12:5 | 2.2 | 7.3 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 21

True odds, recommended payouts and associated house edges for the individual numbers 4, 5, 6, 8, 9 and 10 occurring before either of the numbers 11 or 7.

| Place To Win | True Odds Payout | Recommended Payouts | % 1-Roll House Edge | % Total House Edge |
|---|---|---|---|---|
| 4 | 2.7:1 | 12:5 | 2.2 | 7.3 |
| 5 | 2:1 | 9:5 | 2.2 | 6.7 |
| 6 | 1.6:1 | 9:6 | 1.4 | 3.8 |
| 8 | 1.6:1 | 9:6 | 1.4 | 3.8 |
| 9 | 2:1 | 9:5 | 2.2 | 6.7 |
| 10 | 2.7:1 | 12:5 | 2.2 | 7.3 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 22

True odds, recommended payouts and associated house edges for the individual numbers 4, 5, 6, 8, 9 and 10 occurring before either of the numbers 12 or 7.

| Place To Win | True Odds Payout | Recommended Payouts | % 1-Roll House Edge | % Total House Edge |
|---|---|---|---|---|
| 4 | 2.3:1 | 2:1 | 2.8 | 10.0 |
| 5 | 1.75:1 | 8:5 | 1.7 | 5.5 |
| 6 | 1.4:1 | 8:6 | .93 | 2.8 |
| 8 | 1.4:1 | 8:6 | .93 | 2.8 |

-continued

| Place To Win | True Odds Payout | Recommended Payouts | % 1-Roll House Edge | % Total House Edge |
|---|---|---|---|---|
| 9 | 1.75:1 | 8:5 | 1.7 | 5.5 |
| 10 | 2.3:1 | 2:1 | 2.8 | 10.0 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 23

True odds, recommended payouts and associated house edges for the individual numbers 4, 5, 6, 8, 9 and 10 occurring before either of the numbers 3 or 11.

| Place To Win | True Odds Payout | Recommended Payouts | % 1-Roll House Edge | % Total House Edge |
|---|---|---|---|---|
| 4 | 1.3:1 | 6:5 | 1.1 | 5.7 |
| 5 | 1:1 | 9:10 | 1.1 | 5.0 |
| 6 | .8:1 | 9:12 | .69 | 2.8 |
| 8 | .8:1 | 9:12 | .69 | 2.8 |
| 9 | 1.1:1 | 9:10 | 1.1 | 5.0 |
| 10 | 1.3:1 | 6:5 | 1.1 | 5.7 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 24

True odds, recommended payouts and associated house edges for the individual numbers 4, 5, 6, 8, 9 and 10 occurring before either of the numbers 3 or 12.

| Place To Win | True Odds Payout | Recommended Payouts | % 1-Roll House Edge | % Total House Edge |
|---|---|---|---|---|
| 4 | 1:1 | 10:11 | .76 | 4.5 |
| 5 | .75:1 | 7:10 | .56 | 2.9 |
| 6 | .6:1 | 7:12 | .23 | 1.0 |
| 8 | .6:1 | 7:12 | .23 | 1.0 |
| 9 | .75:1 | 7:10 | .56 | 2.9 |
| 10 | 1:1 | 10:11 | .76 | 4.5 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 25

True odds, recommended payouts and associated house edges for the individual numbers 4, 5, 6, 8, 9 and 10 occurring before either of the numbers 2 or 3.

| Place To Win | True Odds Payout | Recommended Payouts | % 1-Roll House Edge | % Total House Edge |
|---|---|---|---|---|
| 4 | 1:1 | 10:11 | .76 | 4.5 |
| 5 | .75:1 | 7:10 | .56 | 2.9 |
| 6 | .6:1 | 7:12 | .23 | 1.0 |
| 8 | .6:1 | 7:12 | .23 | 1.0 |

-continued

| Place To Win | True Odds Payout | Recommended Payouts | % 1-Roll House Edge | % Total House Edge |
|---|---|---|---|---|
| 9 | .75:1 | 7:10 | .56 | 2.9 |
| 10 | 1:1 | 10:11 | .76 | 4.5 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 26

True odds, recommended payouts and associated house edges for the individual numbers 4, 5, 6, 8, 9 and 10 occurring before either of the numbers 2 or 11.

| Place To Win | True Odds Payout | Recommended Payouts | % 1-Roll House Edge | % Total House Edge |
|---|---|---|---|---|
| 4 | 1:1 | 10:11 | .76 | 4.5 |
| 5 | .75:1 | 7:10 | .56 | 2.9 |
| 6 | .6:1 | 7:12 | .23 | 1.0 |
| 8 | .6:1 | 7:12 | .23 | 1.0 |
| 9 | .75:1 | 7:10 | .56 | 2.9 |
| 10 | 1:1 | 10:11 | .76 | 4.5 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 27

True odds, recommended payouts and associated house edges for the individual numbers 4, 5, 6, 8, 9 and 10 occurring before either of the numbers 11 or 12.

| Place To Win | True Odds Payout | Recommended Payouts | % 1-Roll House Edge | % Total House Edge |
|---|---|---|---|---|
| 4 | 1:1 | 10:11 | .76 | 4.5 |
| 5 | .75:1 | 7:10 | .56 | 2.9 |
| 6 | .6:1 | 7:12 | .23 | 1.0 |
| 8 | .6:1 | 7:12 | .23 | 1.0 |
| 9 | .75:1 | 7:10 | .56 | 2.9 |
| 10 | 1:1 | 10:11 | .76 | 4.5 |

Note:
The bets in the above schedule can also be "bought" to receive the true odds payout in return for a commission paid on bets. By reversing the scenarios and odds, the bets in the above schedule can also be structured as "Place To Lose" and "Lay" bets.

Schedule 28

True odds, recommended payouts and associated house edges for the individual numbers 4, 5, 6, 8, 9 and 10 occurring before either of the numbers 2 or 12.

| Place To Win | True Odds Payout | Recommended Payouts | % 1-Roll House Edge | % Total House Edge |
|---|---|---|---|---|
| 4 | .67:1 | 3:5 | .56 | 4.0 |
| 5 | .5:1 | 5:11 | .51 | 3.0 |
| 6 | .4:1 | 4:11 | .51 | 2.6 |
| 8 | .4:1 | 4:11 | .51 | 2.6 |

-continued

| Place To Win | True Odds Payout | Recommended Payouts | % 1-Roll House Edge | % Total House Edge |
|---|---|---|---|---|
| 9 | .5:1 | 5:11 | .51 | 3.0 |
| 10 | .67:1 | 3:5 | .56 | 4.0 |

Note:

The bets in the above schedule can also be "bought" to receive the true odds payout in return for a commission paid on bets. By reversing the scenarios and odds, the bets in the above schedule can also be structured as "Place To Lose" and "Lay" bets.

Schedule 29

True odds, recommended payouts and associated house edges for the individual numbers 4, 5, 6, 8, 9 and 10 occurring before the number 3.

| Place To Win | True Odds Payout | Recommended Payouts | % 1-Roll House Edge | % Total House Edge |
|---|---|---|---|---|
| 4 | .67:1 | 3:5 | .56 | 4.0 |
| 5 | .5:1 | 5:11 | .51 | 3.0 |
| 6 | .4:1 | 4:11 | .51 | 2.6 |
| 8 | .4:1 | 4:11 | .51 | 2.6 |
| 9 | .5:1 | 5:11 | .51 | 3.0 |
| 10 | .67:1 | 3:5 | .56 | 4.0 |

Note:

The bets in the above schedule can also be "bought" to receive the true odds payout in return for a commission paid on bets. By reversing the scenarios and odds, the bets in the above schedule can also be structured as "Place To Lose" and "Lay" bets.

Schedule 30

True odds, recommended payouts and associated house edges for the individual numbers 4, 5, 6, 8, 9 and 10 occurring before the number 11.

| Place To Win | True Odds Payout | Recommended Payouts | % 1-Roll House Edge | % Total House Edge |
|---|---|---|---|---|
| 4 | .67:1 | 3:5 | .56 | 4.0 |
| 5 | .5:1 | 5:11 | .51 | 3.0 |
| 6 | .4:1 | 4:11 | .51 | 2.6 |
| 8 | .4:1 | 4:11 | .51 | 2.6 |

-continued

| Place To Win | True Odds Payout | Recommended Payouts | % 1-Roll House Edge | % Total House Edge |
|---|---|---|---|---|
| 9 | .5:1 | 5:11 | .51 | 3.0 |
| 10 | .67:1 | 3:5 | .56 | 4.0 |

Note:

The bets in the above schedule can also be "bought" to receive the true odds payout in return for a commission paid on bets. By reversing the scenarios and odds, the bets in the above schedule can also be structured as "Place To Lose" and "Lay" bets.

What is claimed:

1. A method of offering new place bets on a craps game playing surface, comprising:

a.) making an individual wager on the playing surface that a designated count from a first set of counts including the numbers 4, 5, 6, 8, 9 or 10 will occur before the occurrence of any one of a second set of counts including the numbers 2, 3 and 12;

b.) generating a count on the playing surface; and c.) determining if the wager has been satisfied by the count, wherein:

i) the placed wager is won if the designated count from the first set of counts occurs on the playing surface;

ii) the placed wager is lost if any one of the second set of counts occurs on the playing surface; and iii) the placed wager is neither won nor lost if neither the designated count from the first set of counts or any one of the second set of counts occurs on the playing surface.

2. The method of claim 1, wherein the second set of counts further includes the number 11.

3. The method of claim 2, wherein the second set of counts further includes the number 7.

4. The method of claim 2, wherein the second set of counts can include combinations of the numbers 2, 3, 11 and 12.

5. The method of claim 3, wherein the second set of counts can include combinations of the numbers 2, 3, 11 and 12.

6. The method of claim 1, wherein the second set of counts further includes the number 7.

7. The method of claim 1, further comprising making a plurality of individual wagers that a designated count from the first set of counts will occur before any one of the second set of counts.

8. The method of claim 1 further comprising making an individual wager that any one of the second set of counts will occur before a designated count from the first set of counts.

9. The method of claim 1 wherein a random number generator is used in the step of generating a count.

10. The method of claim 1 wherein physical dice are used in the step of generating a count.

* * * * *